US007836729B2

(12) United States Patent
Kirchmair et al.

(10) Patent No.: US 7,836,729 B2
(45) Date of Patent: Nov. 23, 2010

(54) TRANSFER NEEDLE WITH INTERNAL SPRING TIP

(75) Inventors: Klaus Kirchmair, Nusplingen (DE); Frank Weihing, Gomaringen (DE); Jürgen Schneider, Balingen-Frommern (DE); Oskar Schaffer, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 70 days.

(21) Appl. No.: 12/379,577

(22) Filed: Feb. 25, 2009

(65) Prior Publication Data

US 2009/0211304 A1 Aug. 27, 2009

(30) Foreign Application Priority Data

Feb. 27, 2008 (EP) ..... 08003528

(51) Int. Cl.
*D04B 35/02* (2006.01)

(52) U.S. Cl. ..... 66/123; 66/116

(58) Field of Classification Search ..... 66/60 R, 66/64, 116, 119–123, 95, 96 R
See application file for complete search history.

(56) References Cited

U.S. PATENT DOCUMENTS 885,150 A * 4/1908 Foster ..... 66/24
2,667,770 A * 2/1954 Sirmay ..... 66/95
2,997,865 A * 8/1961 Philip ..... 66/24
4,580,419 A * 4/1986 Vincoli ..... 66/123
4,612,786 A * 9/1986 Perotti ..... 66/121
4,646,542 A * 3/1987 Tenconi ..... 66/24
6,298,693 B1 * 10/2001 Schaffer ..... 66/123
6,807,831 B2 * 10/2004 Roth ..... 66/123
2008/0034806 A1 2/2008 Wang

FOREIGN PATENT DOCUMENTS

| | | | |
|---|---|---|---|
| DE | 3018699 | A1 * | 12/1980 |
| DE | 31 45 708 | | 8/1982 |
| DE | 4231015 | A1 * | 3/1993 |
| FR | 1 407 989 | | 8/1965 |
| GB | 419 601 | | 11/1934 |
| JP | 7-192975 | | 7/1995 |
| WO | WO2007057041 | | 5/2007 |

* cited by examiner

*Primary Examiner*—Danny Worrell
(74) *Attorney, Agent, or Firm*—Fitch, Even, Tabin & Flannery; Norman N. Kunitz

(57) ABSTRACT

In a transfer needle (1) having at least one transfer spring (8), this transfer spring (8) is held, on its one end, in a preferably lateral pocket or recess of the needle body, while the tip of the transfer spring is positioned in a longitudinal slit of the needle body. This longitudinal slit (24) has an inlet (25) that is open in longitudinal direction (L) of the needle body (5). The inlet (25) of the longitudinal slit (24) is located at an end of the longitudinal slit (24) away from the hook (6).

10 Claims, 6 Drawing Sheets

TRANSFER NEEDLE WITH INTERNAL SPRING TIP

CROSS-REFERENCE TO RELATED APPLICATIONS

This application claims the benefit of foreign priority under 35 U.S.C. §119 based on European 08 003 528.0, filed Feb. 27, 2008, the entire disclosure of which application is hereby incorporated by reference.

BACKGROUND OF THE INVENTION

The invention relates to a transfer needle that is disposed to act as a knitting tool. In particular, the invention relates to a transfer needle that can be retracted into the needle channel of a needle bed, without the clamping effect of its transfer spring (s).

Knitting tools with transfer springs have been known. For example, WO 2007/057041 discloses a transfer needle having an elongated needle body that is provided with a hook on its one end. The hook is associated with a latch. Both sides of the shaft of the latch needle are provided with recesses in which the rear ends of two transfer springs are held in place. Adjoining their ends, the transfer springs have laterally outward-bent regions and their tips, in turn, are set in the lateral recesses of the needle body.

Such transfer springs are guided—at least in their rear region that is provided with a driving foot—in the needle channels of a knitting machine. The needle channel has a width that is distinctly smaller than the width taken up by the outward-bent regions of the transfer springs. If the needle is retracted very far into the needle channel so that the outward-bent regions must enter in the narrow needle channel, the transfer springs are compressed. In so doing, it may happen that the tips of the transfer needles located in the lateral recesses are spread apart toward the outside. This may lead to increased friction of the needle in the needle channel.

In addition, such practical implementations of knitting tools frequently have a recess or step between the upper needle back and the transfer spring. As a result of this, the half-stitch that slides on the needle shaft in the direction of the transfer spring drops into a relatively deep recess before it may slide further on the transfer spring.

Furthermore, manufacturing tolerances may have the result that the tips of the transfer springs project beyond the thickness of the needle so that half stitches may become caught on the tips when said half stitches slide in the direction of the transfer spring.

Furthermore, a compound needle comprising a slide has been known from JP 33-10684, said slide being disposed to close the inside space of the hook and, in addition, to transfer stitches. The compound needle has a widened breast region which has a longitudinal recess. This recess is open toward the hook of the needle. The slide is supported on the needle so as to be movable in longitudinal direction, said slide having elastic outward-curved arms. Their resilient tips abut against each other and engage from the top into the longitudinal recess. The slide is disposed to open and close the inside space of the hook and also to transfer stitches.

Considering this, it is the object of the invention to create an improved transfer needle.

SUMMARY OF THE INVENTION

The above object generally is achieved according to the present invention with a transfer needle having a longitudinal needle body, and having at least one transfer spring whose one end is permanently connected to the needle body and projects laterally beyond the needle body, and whose other end is seated in a longitudinal slit of the needle body.

The transfer needle in accordance with the invention has at least one transfer spring whose one end is firmly connected to the needle body, i.e., affixed thereto. Starting at this rear end, the transfer spring is curved in lateral direction and thus clearly projects laterally beyond the needle body. The front end of the transfer spring is again bent toward the needle body and enters in a longitudinal slit of the needle body. The front end of the transfer needle is guided so as to be movable in this longitudinal slit. Preferably, the needle body has a uniform width, whereby the width of said needle body is to be measured between its two preferably flat lateral surfaces. In particular, it is viewed as being advantageous when the section of the needle shaft provided with the longitudinal slit is wider than the remaining needle shaft.

As a result of this measure, the transfer needle having at least one or even two transfer springs can be retracted into a needle channel, i.e., without a clamping effect or excess wear occurring. The walls of the needle channel can compress the outward-bent regions of the transfer spring. The resultant elongation of the transfer spring in longitudinal direction has the effect that the front ends of the transfer spring may slide somewhat in the longitudinal slit. In order to facilitate this sliding, the front ends of the transfer springs may be tapered. This taper or reduction of the thickness of the tips of the transfer springs may account for up to 50% of the width of the transfer spring. In special applications, the reduction may even be greater than 50% of the spring width. In so doing, the longitudinal slit of the needle body guides the front ends of the transfer springs and prevents them from rubbing against the wall of the needle channel. In particular, the front ends of the transfer springs are prevented from spreading outward and being damaged themselves, or from causing damage to the walls of the needle channel.

By guiding the front ends of the transfer springs in the longitudinal slit, the needle body has smooth exterior sides in this region, so that the half stitches sliding over these exterior sides of the needle shaft will not catch on the pointed front ends of the transfer springs. In addition, the transfer spring may smoothly adjoin the upper narrow surface of the needle shaft, so that the half stitches may slide from the needle shaft to the transfer springs without being impaired.

The longitudinal slit has an inlet through which enter the front tip(s) or end(s) of the at least one transfer spring, or of the transfer springs, into the longitudinal slit. Preferably, this inlet is provided on the side of the longitudinal slit that faces away from the hook of the transfer needle. The inlet is understood to mean an opening that is open toward the fixed rear ends of the at least one transfer spring.

Furthermore, in many cases it is advantageous if the longitudinal slit is open—in longitudinal direction—on the side facing the hook as well as on the side facing away from the hook. In particular, this applies to the use of needle bodies having a relatively short longitudinal slit. In so doing, the tip of the at least one transfer spring—when it enters into the needle channel of a needle bed—is enabled to exit again on the hook-side end of the longitudinal slit. This also applies to transfer needles with two transfer springs. If the tips of the transfer springs in compressed state project partially beyond the slit end, they may slightly incline toward the outside, without coming into direct contact with the wall of the needle channel. As a result of this release of the tips of the transfer springs, the force required for compressing the two springs is reduced in order to insert the transfer spring into the needle channel. As a result of this, frictional forces that would otherwise occur between the transfer needle and the needle channel can be prevented.

This effect can also be achieved in that at least one of the walls delimiting the longitudinal slit of the needle body is provided with a lateral break-through into which the tip of the transfer spring may bulge or spread.

If the transfer needle has two transfer springs, their front ends or tips—in operative position—abut against each other in a resilient manner in the longitudinal slit. Even when the transfer springs are compressed, the contact between the two front ends is maintained. At most, the point at which the transfer springs are in contact with each other moves slightly in longitudinal direction. Inasmuch as the transfer springs meet in the center plane of the transfer needles, said springs may spread somewhat toward the outside (for example, through the openings of the lateral walls of the longitudinal slit) without coming into direct contact with the needle channel wall. This represents a considerable advantage compared to the transfer needles whose transfer springs are supported in lateral pockets of the needle body.

Additional details of advantageous embodiments of the invention are the subject matter of the drawing, the description and the claims. The description is restricted to essential aspects of the invention and miscellaneous aspects. The drawings disclose additional details and are to be referred to as being supplementary.

DETAILED DESCRIPTION OF THE INVENTION

Figure 1:
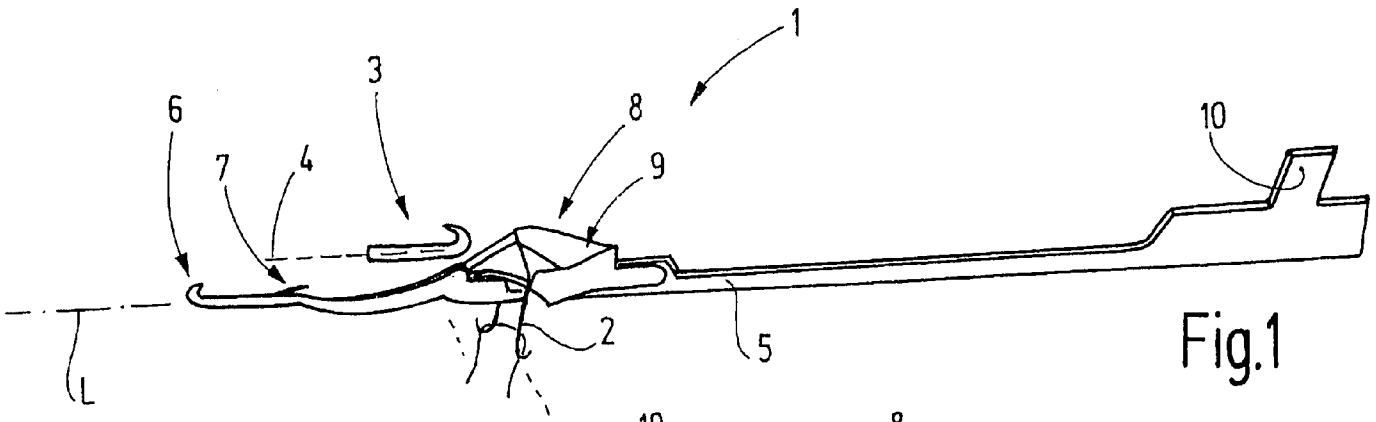
FIG. 1 is a schematic perspective illustration of a transfer needle in accordance with the invention.

FIG. 1 shows a transfer needle 1 that carries a half stitch 2. The half stitch 2 is formed by a section of a stitch that projects from a knit fabric that is in the process of being created. The transfer needle 1 may be associated with one or more additional needles 3 that move, for example, along an axis 4 that extends relative to the transfer needle 1 in order to take over the half stitch 2 as needed.

The transfer needle 1 has a longitudinal needle body 5 that extends in a longitudinal direction L. On one end, the needle body 5 is provided with a hook 6. The hook 6 is associated with a latch 7 that—like in any other latch needle—is also pivotally supported. FIG. 1 shows the latch 7 in its rear position. The latch 7 can be pivoted toward the hook 6 and abut against it in order to enclose a thread or a half stitch. The needle body 5 carries at least one, preferably however, two transfer springs 8, 9 consisting of thin spring steel sheet material, said springs being fixed in position on the needle body 5. These transfer springs 8, 9 form a transfer region which is disposed to transfer the half stitch 2 to other knitting tools, e.g., needles 4.

The transfer region is adjoined by a more or less long shaft section. The needle body 5 may additionally be provided with at least one drive foot 10 or other drive means. For example, the needle body may be provided with coupling means in order to connect drive elements such as, for example, a foot needle or the like.

Considering the preferred embodiment, the transfer springs 8, 9 are configured mirror-image-like with respect to each other. If necessary, however, they may also have different forms. Each of them has a holding section 11, 12 in the form of an attachment end, as is obvious from FIGS. 2, 3 and 4. The attachment end 11, 12 is a plate-like fiat section, for example, from which extends an extension 13, 14 in upward direction, said extension acting to secure the transfer springs 8, 9 in axial direction. The holding sections 11, 12 are arranged in a lateral recess 15 that is provided in the needle body 5. The recess 15 is configured, e.g., as a flat groove, whereby the holding section 12 abuts against the flat bottom of said groove. The holding section 11 may be positioned in a congruent manner on the holding section 12. The recess 15 may have a cutout 16 that extends up to the upper narrow flat side 17 of the shaft of the needle body 5 and breaks through said flat side. The extensions 13, 14 may extend into the cutout 16 of the recess 15 and thus fix the transfer springs 8, 9 in axial direction. In so doing, it is possible that the extensions 13, 14 project minimally beyond the narrow flat side 17. The holding sections 11, 12 may be attached to the needle body by crimping, welding, cementing, soldering or in another manner.

Extending from the holding sections 11, 12 toward the hook 6, there are resilient sections 18, 19 of the transfer springs 8, 9. The sections 18, 19 define, between them, a distance that exceeds the width of the needle body 5. The width of the needle body 5 is measured between its two parallel large flat sides 35, 36.

The front ends of the sections 18, 19 terminate in arms 20, 21 that extend toward each other. On their front ends 22, 23, the arms 20, 21 are in contact with each other. The ends 22, 23, in so doing, extend into a longitudinal slit 24 that is preferably open on the upper side of the needle body 5. The longitudinal slit 24 is arranged in a section of the needle body 5 having a width that matches the width of the needle body in the remaining transfer section. In other words, the walls of the longitudinal slit 24 are not curved in outward direction but are straight.

Figure 2:
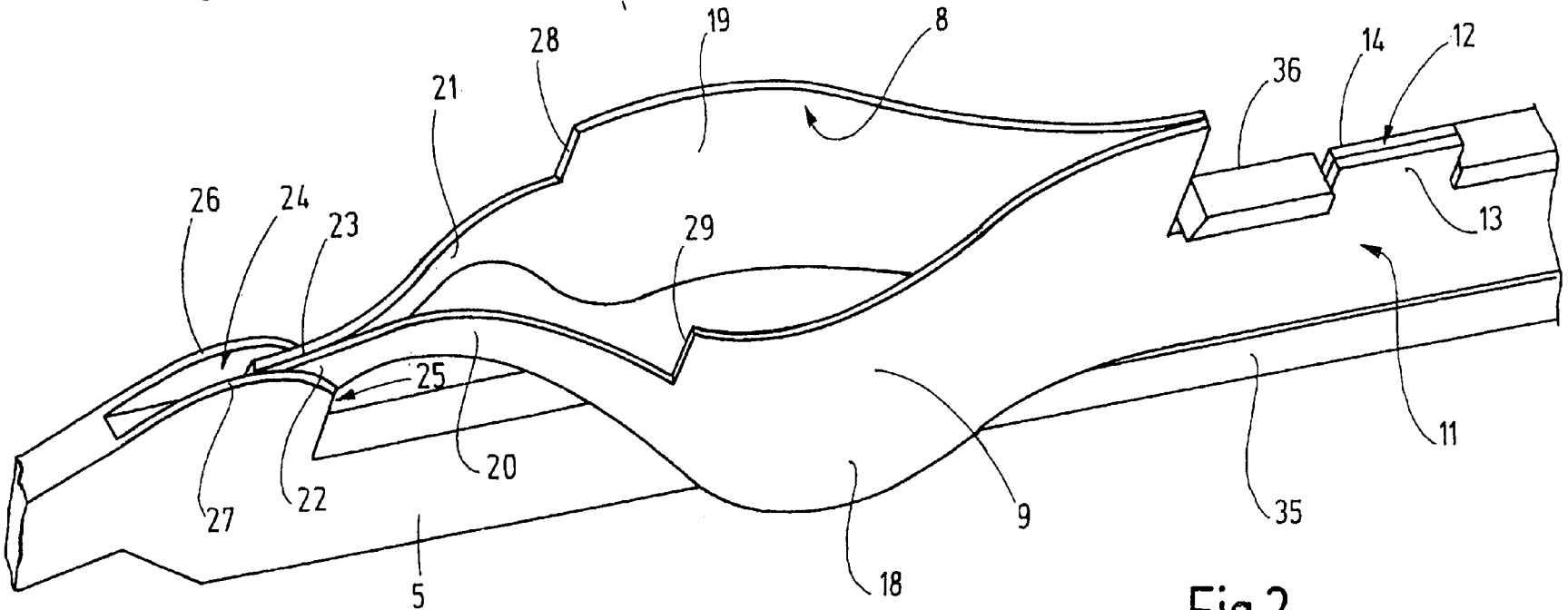
FIG. 2 is a perspective view of an enlarged detail of the transfer needle in accordance with FIG. 1.

As is shown by FIGS. 1 and 2, the longitudinal slit 24 is open on its end remote from the hook 6. There, it has an inlet 25 that is open toward the holding sections 11, 12. The ends 22, 23 extend through the inlet 25 into the longitudinal slit. In addition, the longitudinal slit 24 is open on the upper side of the needle. The longitudinal slit 24 is delimited by two walls that are parallel to each other and limit the longitudinal slit 24 relative to the exterior, preferably smooth, flat sides 35, 36. The tips of the transfer springs 8, 9 are held between the walls of the longitudinal slit and are held away from the walls of the needle channel.

Preferably, the inlet 25 is arranged on a step. The upper edges 26, 27 of the walls delimiting the longitudinal slit 24 adjoin the ends 22, 23 and the arms 20, 21, respectively, as a curved arc or also as a straight surface. As a result of this, an almost stepless transition is created from the region of the needle body 5 having the longitudinal slits 24 to the ends 22, 23 and arms 20, 21, respectively, of the transfer springs 8, 9.

A half stitch may slide, without impairment, over this transition from the needle body 5 onto the arms 20, 21 of the transfer spring 8, 9. In so doing, a uniform, gentle sliding of the half stitch from one part of the transfer needle 1, the needle base body 5, to another part of the transfer needle 1, the transfer spring 8, 9, is possible. The upper edges 26, 27 terminate at the inlet 25 in the step existing there.

The ends 22, 23 are guided in the longitudinal slit 24 in a sliding manner. Together, they have a width that is minimally smaller than the inside width of the longitudinal slit 24. As is shown by FIG. 2, the longitudinal slit 24 may be open not only on the inlet 25 and on its upper side but, in addition, may also be open toward the hook 6. As illustrated, the arms 20, 21 may be essentially straight on their upper side. They may terminate, e.g., in the sections 18, 19, in the stitch support shoulders 28, 29.

Figure 3:
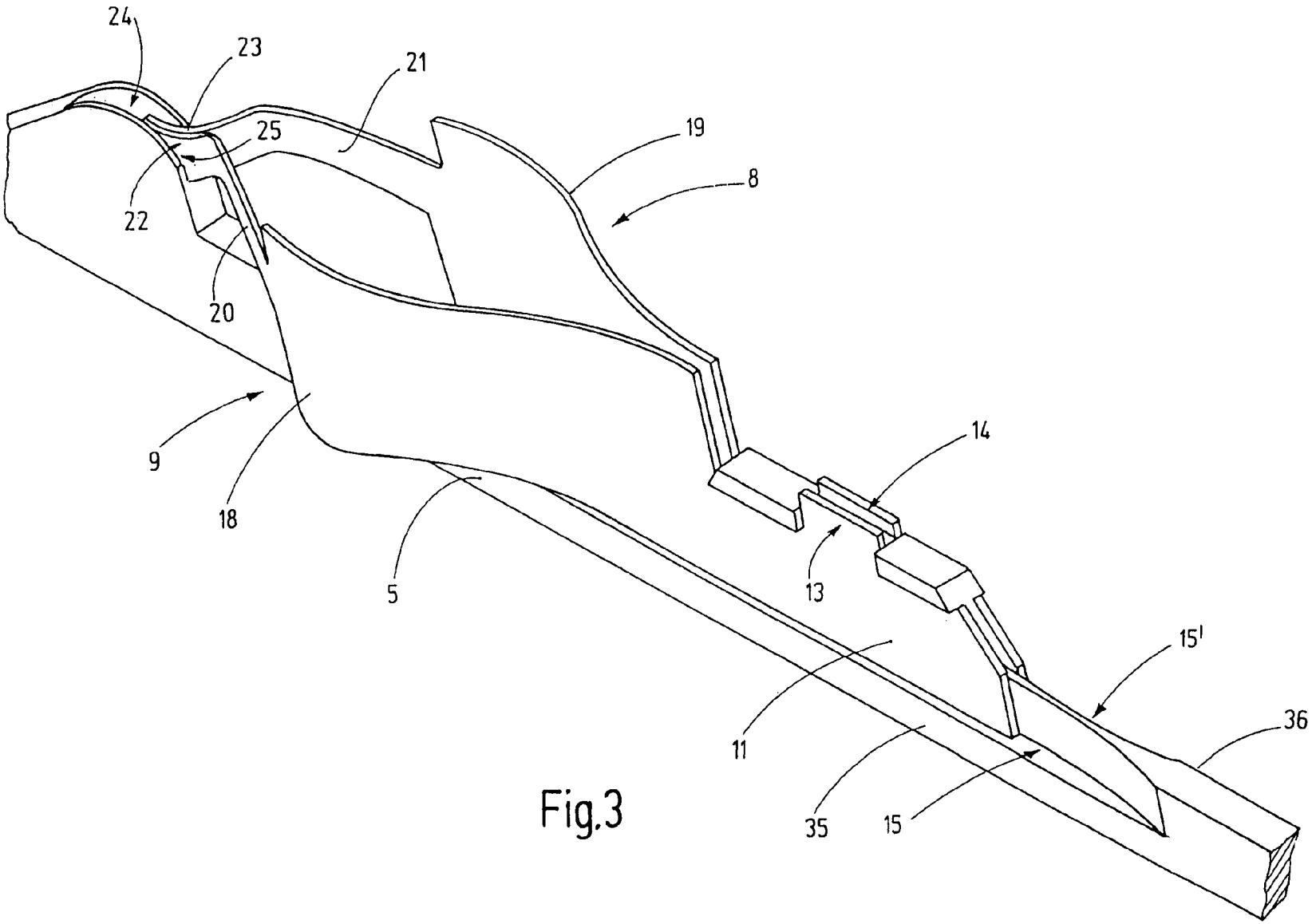
FIG. 3 is another perspective view of a detail of the transfer needle in accordance with FIG. 2.
Figure 4:
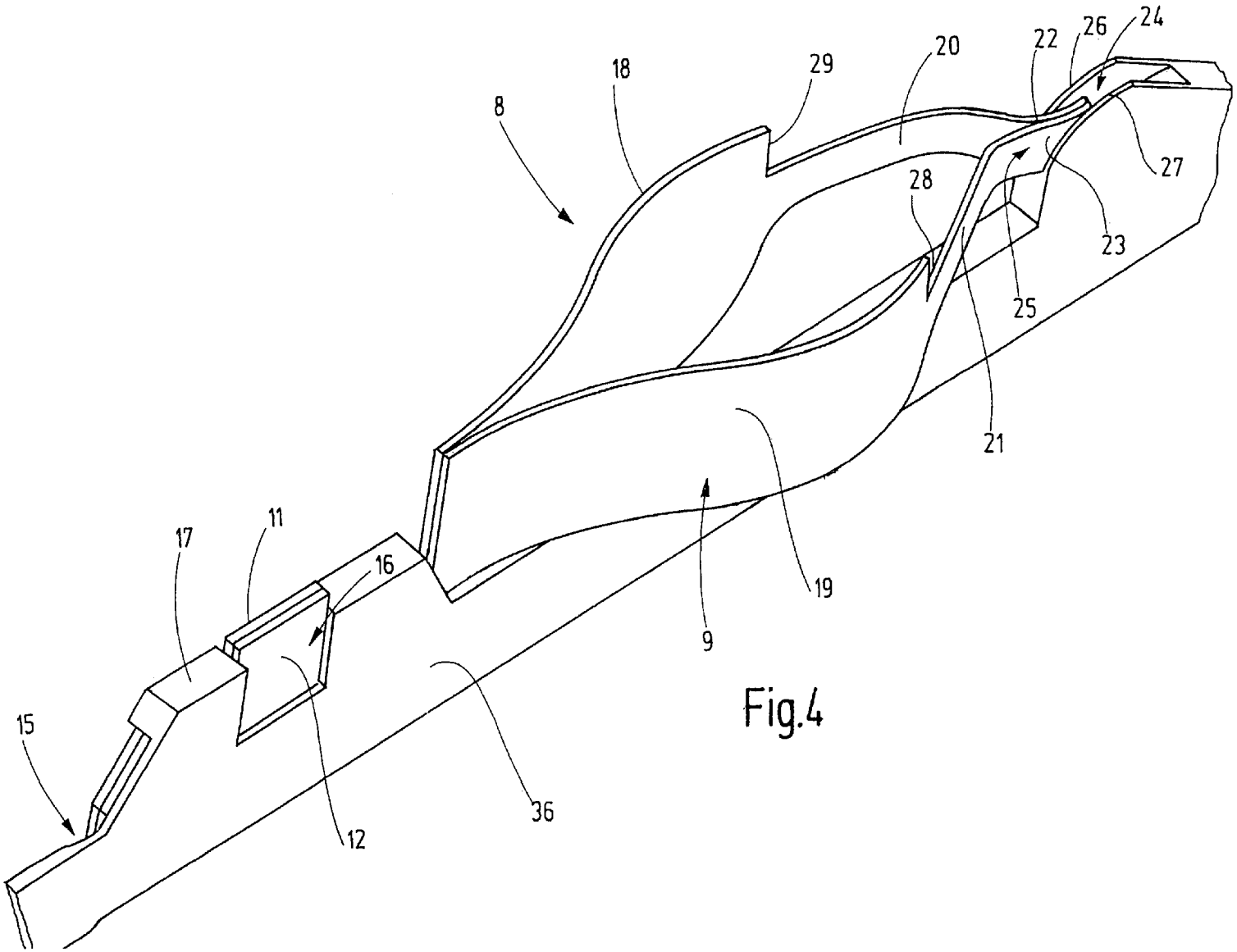
FIG. 4 is another perspective view of the transfer needle in accordance with FIGS. 1 through 3.

FIG. 3 shows alternative exemplary embodiment for attaching the transfer springs 7, 8 of the transfer needle. The needle body 5 may have its own separate recess 15, 15' for each transfer spring 8, 9. This first recess 15 extends from the large flat side 35 into the needle body 5 and receives the transfer spring 9. The second recess 15' extends from the large flat side 34 into the needle base body and receives the transfer spring 8. Other features are identical to those described above; consequently, reference is made—accordingly—to the above description.

The transfer needle 1 described so far works as follows:

As is obvious from FIG. 1, the transfer needle 1 may take up the half stitch 2. It may slide from the hook 6 over the needle shaft up to the transfer springs 8, 9 and are spread by these, for example. They may come into abutment with the stitch support shoulders 28, 29 and be taken over in spread form by another knitting tool, for example, the needle 3. To do so, sufficient intermediate space exists between the transfer spring 6 and large flat side 34 (FIG. 4) and between the transfer spring 9 and the large flat side 36 (FIG. 2), into which, as illustrated, the needle 3 may immerse parallel to the longitudinal direction 1 or also at an angle with respect thereto. If required, the needle body 5 may be provided with a cutout 30 to facilitate this process, whereby it is also possible for said cutout to accommodate downward-directed extensions of the sections 18, 19 when the transfer springs 8, 9 are compressed.

When performing the knitting operation, the transfer needle 1 is moved back and forth in longitudinal direction L in a needle bed. Motion is imparted by the drive foot 10. The needle channel is delimited by two channel walls having a distance from each other that is slightly greater than the width of the needle body 5. If the transfer needle 1 is moved far enough into the needle channel for the transfer springs 8, 9 to enter into the intermediate space between the channel walls, the transfer springs 8, 9 are compressed. As a result of this, the ends 22, 23 in the longitudinal slit 24 of the needle body 5 are pushed forward. However, the ends 22, 23 are prevented from coming into contact with the channel walls of the needle channel.

In addition, the ends 22, 23 are prevented from coming into contact with the half stitch 2 in each operating mode. In so doing, the half stitch 2 is prevented from becoming caught or damaged.

Figure 5:
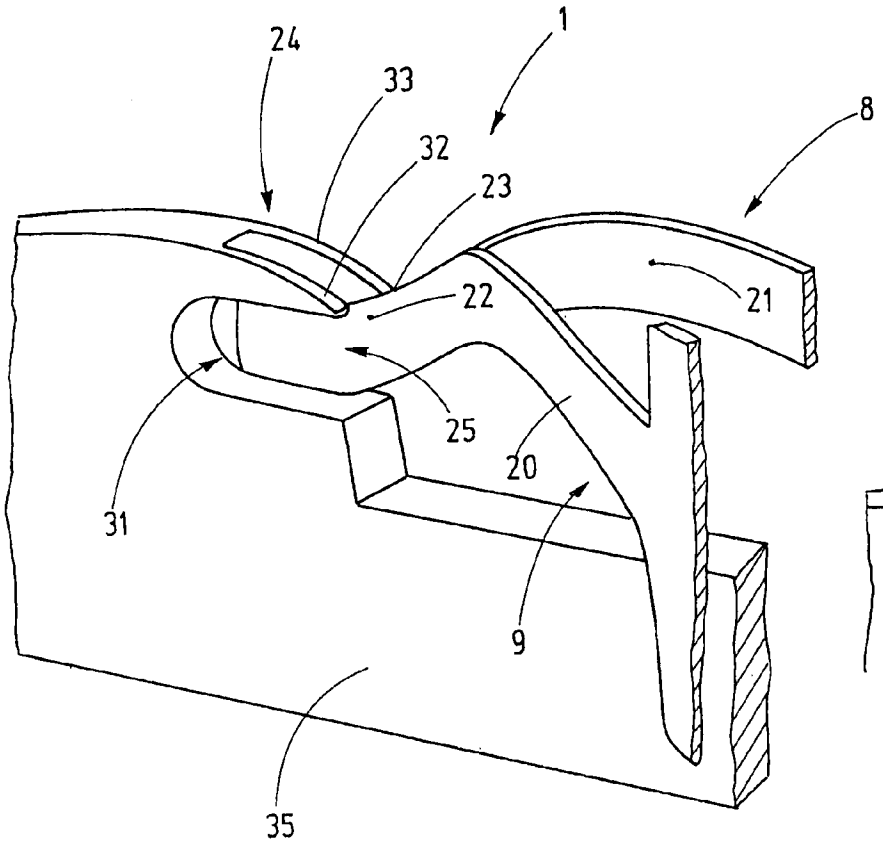
FIG. 5 is a perspective view of a detail of a modified embodiment of the transfer needle in accordance with the invention.

FIG. 5 shows a slightly modified embodiment of the transfer needle 1. The modification is restricted to the configuration of the longitudinal slit 24, which is why the illustration in FIG. 5 is restricted to the corresponding section of the transfer needle 1. The walls delimiting the longitudinal slit 24 are provided with an opening 31 that extends transversely to the longitudinal direction L, which opening may terminate in the inlet 25. Only the prongs 32, 33 remain of the walls of the longitudinal slit 24, said prongs extending parallel to each other and forming a fork. The ends 22, 23 of the transfer springs 8, 9 remain between these prongs 32, 22. However, the outermost tips of the ends 22, 23 may also pivot somewhat outward through the opening 31 underneath the prongs 32, 33.

If the transfer springs 8, 9 are compressed, the outermost tips of the ends 22, 23 that are in contact with each other may pivot underneath the prongs 32, 33. As a result of this, the force that is required for compressing the two springs 8, 9 is reduced. Thus, the transfer needle 1 maybe inserted more easily in its needle channel. Greatly increased frictional forces between the transfer needle 1 and the walls of the needle channel are avoided.

Figure 6:
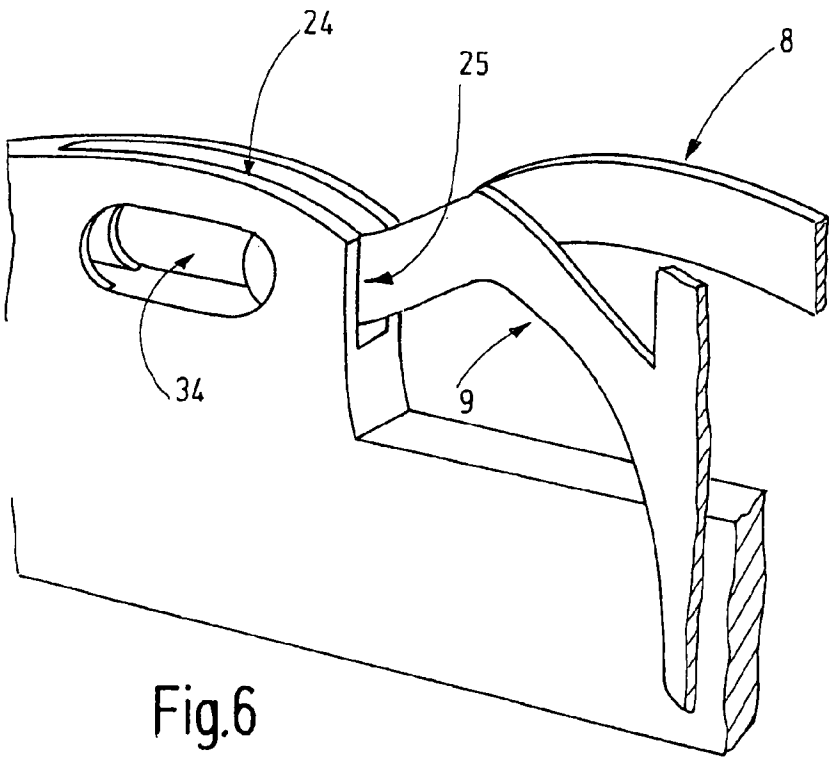
FIG. 6 is a perspective view of a detail of another modified embodiment of the transfer needle in accordance with the invention.

Furthermore, as is shown by FIG. 6, the walls delimiting the longitudinal slit 24 are provided with one or more transverse openings 34 that do not communicate with the inlet 25. Also, in this case, the one or more transverse openings 34 that, e.g., are configured as in FIG. 6, permit a clamping of the tips of the transfer springs 8, 9; and a particular easy moving of the transfer spring 1 in the needle channel is made possible.

Figure 7:
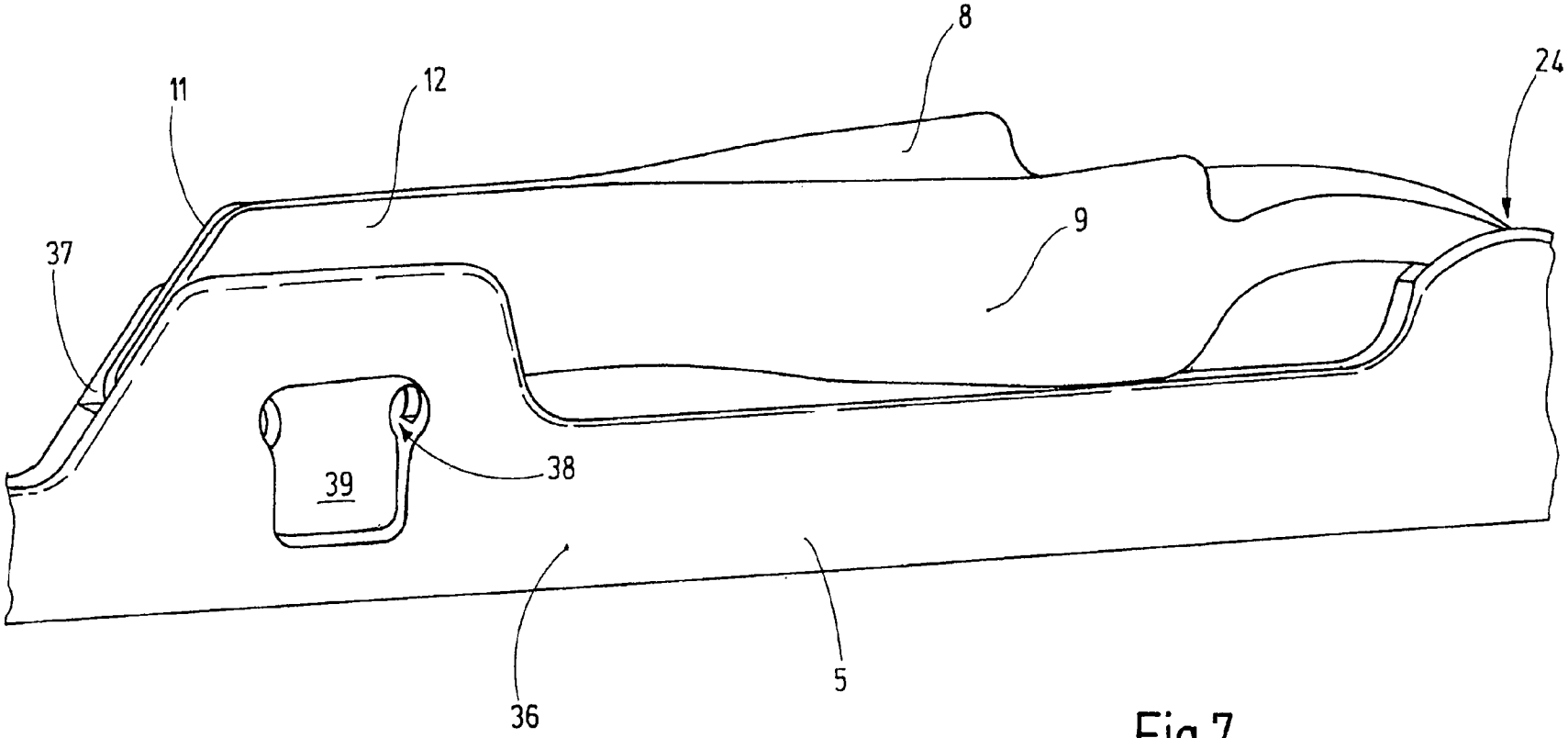
FIG. 7 is a perspective view of the latch needle with an alternative spring attachment.
Figure 8:
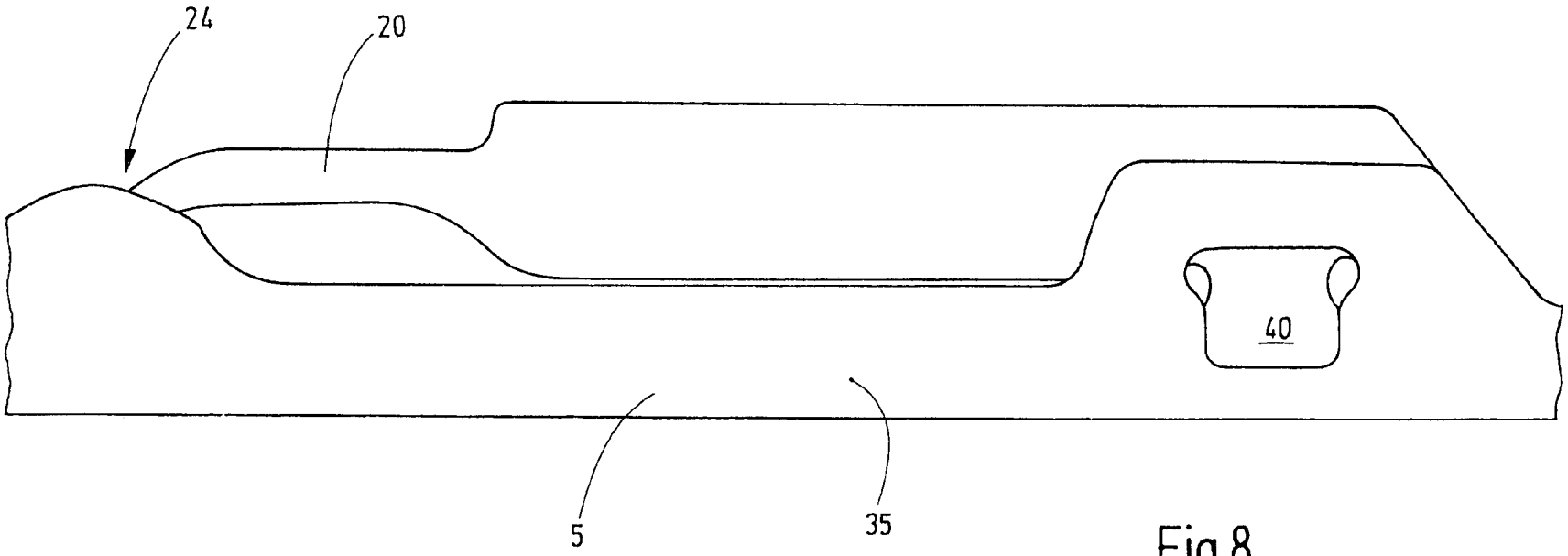
FIG. 8 is a side view of the latch needle in accordance with FIG. 7.

FIGS. 7 and 8 show an alternative embodiment with a modified attachment of the transfer springs 8, 9. To accommodate them, an appropriate rear shaft section is provided with a receiving slit 37 that extends in longitudinal direction of the needle body 5 and is open toward the top, i.e., away from the needle back. The two holding sections 11, 12 extend abutting against each other into this receiving slit 37. A transverse opening 38 extends through the needle body 5 and thus cuts the receiving slit 37. In principle, the transverse opening 38 may have any desired form. For example, it may be slightly rectangular or square. The holding sections 11, 12 are provided with feet 39, 40 that extend beyond the bottom of the receiving slits 37 in downward direction into the opening 36. A plastic deformation of the edges of the transverse opening 30 and/or the feet 39, 40 creates a lasting permanent connection between the needle body 5 and the holding springs 8, 9. Instead of the deformation, it is also possible to provide a connection by welding, cementing, soldering or the like.

In an inventive transfer needle 1 having at least one transfer spring 8, this transfer spring 8 is held, on its one end, in a preferably lateral pocket or recess of the needle body, while the tip of the transfer spring is positioned in a longitudinal slit of the needle body. This longitudinal slit 24 has an inlet 25 that is open in longitudinal direction L of the needle body 5. The inlet 25 of the longitudinal slit 24 is located at an end of the longitudinal slit 24 away from the hook 6.

It will be appreciated that the above description of the present invention is susceptible to various modifications, changes and modifications, and the same are intended to be comprehended within the meaning and range of equivalents of the appended claims.

REFERENCE NUMERALS

1 Transfer needle
2 Half stitch
3 Needle
4 Axis
5 Needle body
L Longitudinal direction
6 Hook
7 Latch
8, 9 Transfer springs
10 Drive foot
11, 12 Holding section
13, 14 Extension

15, 15' Recess
16 Cutout
17 Flat side
18, 19 Section
20, 21 Arms
22, 23 Ends
24 Longitudinal slit
25 Inlet
26, 27 Edges
28, 29 Stitch support shoulder
30 Cutout
31 Opening
32, 33 Prongs
34 Transverse openings
35, 36 Flat side
37 Receiving slit
38 Transverse opening
39, 40 Feet

What is claimed is:

1. Transfer needle having a longitudinal needle body, and having two transfer springs each having one end permanently connected to the needle body and projecting laterally beyond the needle body, and having another end seated in a longitudinal slit of the needle body; and wherein the tips of two transfer springs are guided with minimal play in the longitudinal slit, and the tips of the two transfer springs are in abutment with each other in the longitudinal slit.

2. Transfer needle in accordance with claim 1, wherein the longitudinal slit has an inlet that is open toward the fixed end of the transfer spring.

3. Transfer needle in accordance with claim 1, wherein the needle body has an elongated form and has a hook on its one end, and wherein the longitudinal slit is open on a side facing away from the hook.

4. Transfer needle in accordance with claim 3, wherein the longitudinal slit is open on a side facing away from the hook as well as on a side facing the hook.

5. Transfer needle in accordance with claim 1, wherein the slit has at least one opening toward a flat side of the needle body.

6. Transfer needle in accordance with claim 1, wherein the transfer springs are bent away from each other in a center region.

7. Transfer needle in accordance with claim 1, wherein the transfer springs have tips that are tapered on their front end.

8. Transfer needle in accordance with claim 1, wherein each of the transfer springs is guided, on its fixed end, in a laterally open pocket of the needle body.

9. Transfer needle in accordance with claim 1, wherein the needle body has two recesses, each recess accommodating one of the transfer springs.

10. Transfer needle in accordance with claim 9, wherein the first recess extends from one large flat side of the needle body and the second recess extends from an opposite large flat side into the needle body.

* * * * *